US007344484B1

(12) United States Patent
Porcellato

(10) Patent No.: US 7,344,484 B1
(45) Date of Patent: Mar. 18, 2008

(54) MULTI-EXERCISE APPARATUS FOR CHAIR BASE ATTACHMENT

(76) Inventor: Mark A. Porcellato, 18/150 Dean Street, Strathfield (AU) NSW 2136

( * ) Notice: Subject to any disclaimer, the term of this patent is extended or adjusted under 35 U.S.C. 154(b) by 0 days.

(21) Appl. No.: 11/618,517

(22) Filed: Dec. 29, 2006

(51) Int. Cl.
*A63B 21/02* (2006.01)

(52) U.S. Cl. ..... 482/123; 482/126

(58) Field of Classification Search ..... 482/121–126, 482/142

See application file for complete search history.

(56) References Cited

U.S. PATENT DOCUMENTS 1,929,107 A * 10/1933 Weaver ..... 601/99
5,176,601 A * 1/1993 Reynolds ..... 482/130
5,324,243 A * 6/1994 Wilkinson ..... 482/92
5,362,296 A * 11/1994 Wang et al. ..... 482/133
5,674,167 A * 10/1997 Piaget et al. ..... 482/130
6,013,014 A * 1/2000 Hern ..... 482/121
6,063,012 A 5/2000 Berkowitz et al.
6,099,445 A * 8/2000 Rovinsky et al. ..... 482/121
6,110,081 A * 8/2000 Barrett ..... 482/121
6,312,366 B1 11/2001 Prusick
7,128,700 B2 * 10/2006 Wallach ..... 482/130

* cited by examiner

*Primary Examiner*—Lori Amerson
(74) *Attorney, Agent, or Firm*—Crossley Patent Law; Mark A. Crossley

(57) ABSTRACT

A multi-exercise apparatus for chair base attachment to an office chair or other commonly used chair. The attachment is easily engaged and disengaged via the clamp. The apparatus provides loops disposed at the clamp and on the upper end of the vertical member. The loops provide for attachment of the elastomers of the apparatus. The elastomers are provided with varied handles for various exercise choices. A user can perform a variety of exercises and exercises for opposed muscles groups, thereby benefiting from balanced exercises from the chair. The apparatus does not interfere with normal chair usage.

16 Claims, 5 Drawing Sheets

MULTI-EXERCISE APPARATUS FOR CHAIR BASE ATTACHMENT

BACKGROUND OF THE INVENTION

The busy life led by many often negates the free time needed for exercise. A sedentary lifestyle, especially at work, contributes to the problem of a general lack of fitness for many. What is needed is a device which can provide for a user to perform a variety of exercises while seated, as in an office chair. The ideal device should not be a hindrance when not in use. The ideal device should provide for stomach contraction, antagonist exercise, and a variety of other exercises also. The present apparatus provides the needs of an ideal chair attached device.

FIELD OF THE INVENTION

The multi-exercise apparatus for chair base attachment relates to multi-exercise devices and more specifically to a multi-exercise apparatus for attachment to a personal chair base.

DESCRIPTION OF THE PRIOR ART

Prior related art does not offer the same attachment to a personal chair, such as an office chair, as does the present invention, nor does prior art offer the same versatility and non-intrusive attachment of the present apparatus. For example, U.S. Pat. No. 6,312,366 issued to Prusick on Nov. 6, 2001 teaches a bar for attachment onto the back support of a chair. The device differs not only in chair attachment, but also is more limited in exercises which can be performed, as compared to the present apparatus. U.S. Pat. No. 6,063,012 issued to Berkowitz, et al. on May 16, 2000 teaches a device for wrap-around attachment to a chair back. The device interferes with a person seated in the chair, when not in use. U.S. Pat. No. 6,013,014 issued to Hem on Jan. 1, 2000 teaches a curved plate device for attachment about a couch back. The device cannot be used with a personal chair, such as an office chair, as does the present apparatus.

While the above-described devices fulfill their respective and particular objects and requirements, they do not describe a multi-exercise apparatus for chair base attachment that provides for the advantages of the multi-exercise apparatus for chair base attachment. In this respect, the present multi-exercise apparatus for chair base attachment substantially departs from the conventional concepts and designs of the prior art. Therefore, a need exists for an improved multi-exercise apparatus for chair base attachment.

SUMMARY OF THE INVENTION

The general purpose of the multi-exercise apparatus for chair base attachment, described subsequently in greater detail, is to provide a multi-exercise apparatus for chair base attachment which has many novel features that result in an improved multi-exercise apparatus for chair base attachment which is not anticipated, rendered obvious, suggested, or even implied by prior art, either alone or in combination thereof.

To attain this, the multi-exercise apparatus for chair base attachment provides for attachment to a chair base of an office chair or similar chair. The attachment is easily engaged and disengaged via the clamp. The apparatus provides loops disposed at the clamp and on the upper end of the vertical member. The loops provide for attachment of the elastomers of the apparatus. The elastomers are provided with varied handles for various exercise choices. A user can perform a variety of exercises for opposed muscles groups, thereby enjoying a variety of balanced exercises from the chair. For example, the loop clips of either one or two elastomers can be fastened to the vertical member loops. The user can them perform stomach curls, the apparatus providing resistance against forward torso movement in the chair via grip of the handles or knobs. The user might then attach the triangular handled elastomers and hold the handles at their shoulders. Thereby placed in a forward leaning position, the user then uses the muscles of the lower back to lean backward. Therein, the antagonist muscles of the lower back are exercised.

Another exercise which a user might perform using the present multi-exercise apparatus for chair base attachment involves placing the user's feet in the triangular handles. The legs are then used to push the user's feet outwardly from the chair. The elastomers are provided in varied lengths and thickness to further aid in providing varied tension against exercises performed. The various exercises which can be performed using the multi-exercise apparatus for chair base attachment are limited only by imagination. The elastomers may be crossed over body parts and used at almost any angle. Shoulder presses, arm curls, deltoid raises, and side bends are only a few examples of possible resistance exercises which may be performed using the present apparatus.

Thus has been broadly outlined the more important features of the improved multi-exercise apparatus for chair base attachment so that the detailed description thereof that follows may be better understood and in order that the present contribution to the art may be better appreciated.

An object of the multi-exercise apparatus for chair base attachment is to provide for performance of a plurality of exercises, from a chair.

Another object of the multi-exercise apparatus for chair base attachment is to provide a basic apparatus.

A further object of the multi-exercise apparatus for chair base attachment is to provide for inexpensive exercise.

An added object of the multi-exercise apparatus for chair base attachment is to provide for rigid, sturdy chair base attachment.

And, an object of the multi-exercise apparatus for chair base attachment is to provide for exercises without interference of normal chair use.

These together with additional objects, features and advantages of the improved multi-exercise apparatus for chair base attachment will be readily apparent to those of ordinary skill in the art upon reading the following detailed description of presently preferred, but nonetheless illustrative, embodiments of the improved multi-exercise apparatus for chair base attachment when taken in conjunction with the accompanying drawings.

In this respect, before explaining the current embodiments of the improved multi-exercise apparatus for chair base attachment in detail, it is to be understood that the multi-exercise apparatus for chair base attachment is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved multi-exercise apparatus for chair base attachment. It is therefore important that the claims be regarded as including such equivalent constructions insofar as they do not depart from the spirit and scope of the multi-exercise apparatus for chair base attachment. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the multi-exercise apparatus for chair base attachment generally designated by the reference number 10 will be described.

Figure 1:
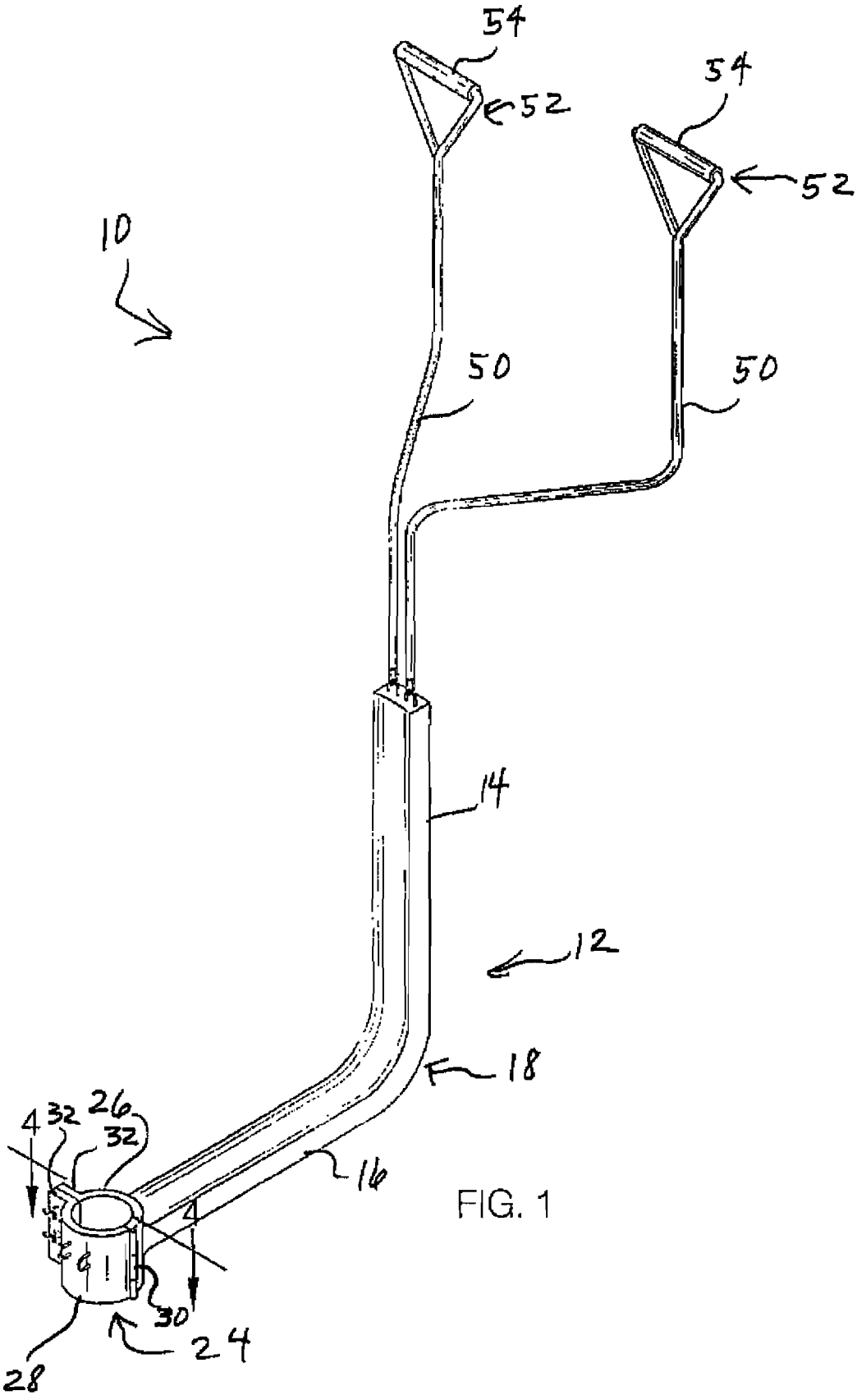
FIG. 1 is a perspective view of the apparatus with triangulated handles on the elastomers, the elastomers clipped to the top of the post.
Figure 2:
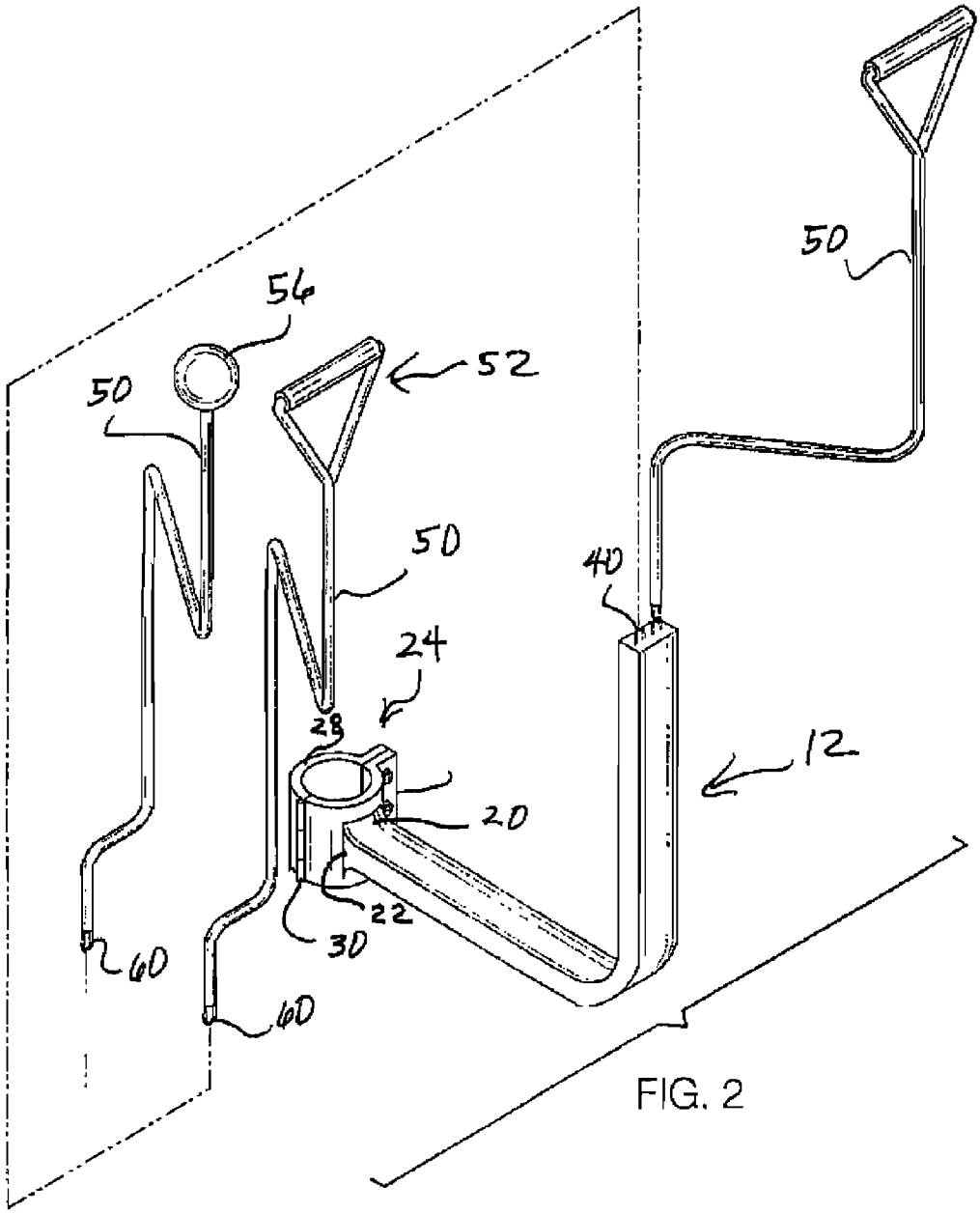
FIG. 2 is a perspective view of the apparatus.

Referring to FIGS. 1 and 2, the apparatus 10 for attachment to a chair base 82 of a chair 80 comprises a parallelepiped post 12. The post 12 is comprised of a vertical member 14 having a top and a bottom. A pair of spaced apart loops 40 is affixed to the top of the vertical member 14. The 90 degree bend 18 is disposed at the bottom of the vertical member 14. The horizontal member 16 is extended seamlessly from the 90-degree bend 18.

The circlamp 24 is affixed to the end of the horizontal member 16. Two pair of elastomers 50 are provided. Each of the first pair and the second pair of elastomers 50 has a first end, a second end, and a length therebetween. The loop clip 60 is disposed on the first end of each of the first pair and the second pair of elastomers 50. A triangular handle 52 is disposed on the second end of each of the first pair of elastomers 50. One example of the triangular handle further comprises a handle cylinder 54. The handle cylinder 54 freely rotates about the handle 52 for easier grip while performing various exercises with the apparatus 10. A knob 56 is disposed on the second end of each of the second pair of elastomers 50. In one example of the post 12, the horizontal member 16 is further comprised of a horizontal flare 20 encompassing an end of the horizontal member 16. The flare 20 provides greater structural integrity in the joining of the horizontal member 16 to the clamp 24 at the molded attachment 22.

Figure 4:
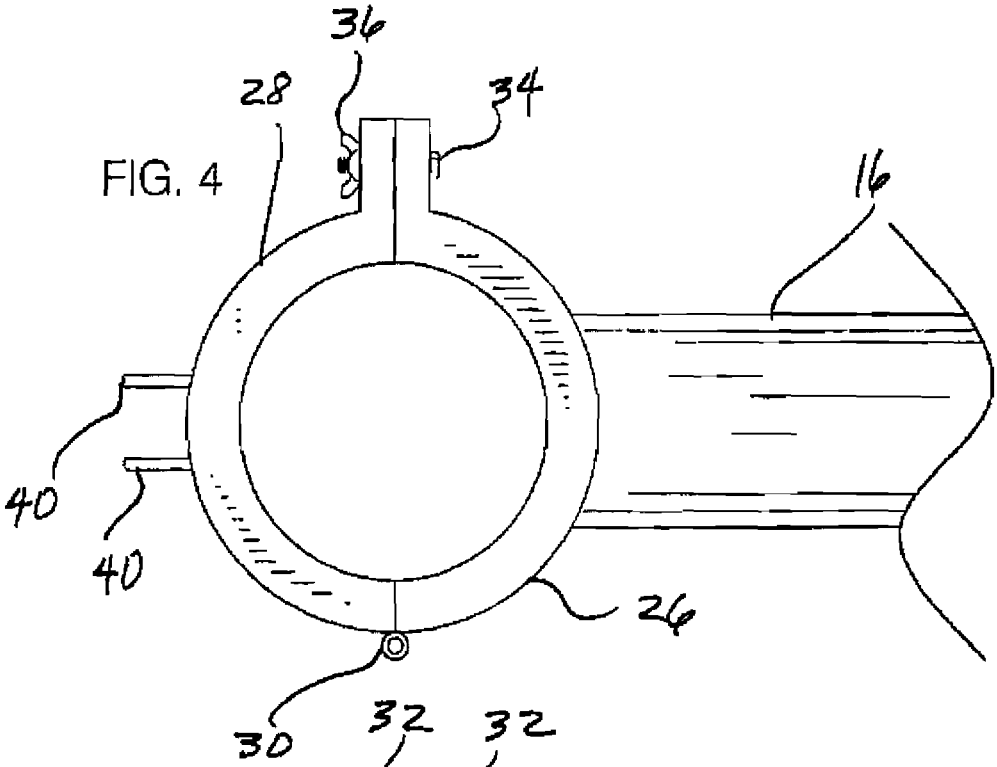
FIG. 4 is a top plan view of an embodiment of the post horizontal member.

Referring to FIG. 4, the circlamp 24 comprises a semicircular first clamp side 26. The first clamp side 26 is affixed to the horizontal flare 20. The semicircular second clamp 28 side is hingedly affixed to the first clamp side 26 via the hinge 30. A clamp side extension 32 is disposed on each of the first clamp side 26 and the second clamp side 28. Depending upon the example of the circlamp 24, one or more clamp studs 34 is passed through each clamp side extension 32. The illustrated example of the circlamp 24 provides 2 clamp studs 34. A wing nut 36 is provided for each clamp 34 such that the circlamp 24 is selectively tightened around the base 82 of a chair 80. A pair of spaced apart loops 40 is affixed to the second clamp side 28 of the circlamp 24.

Figure 5:
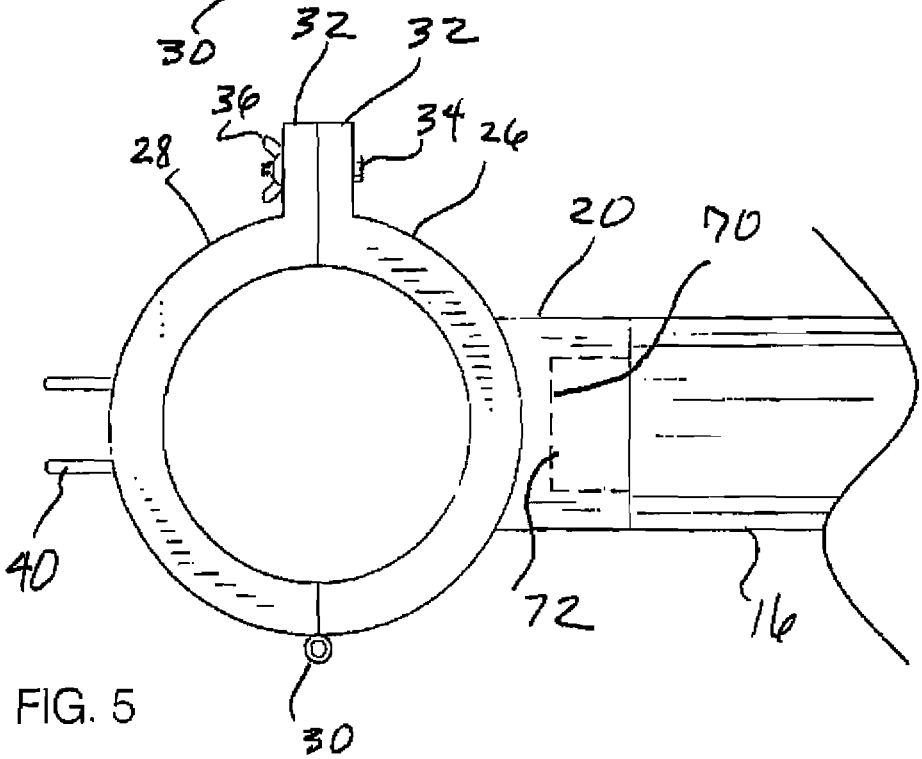
FIG. 5 is a top plan view of an alternate embodiment of the post horizontal member, with flare inset and insert of the horizontal member.

Referring to FIG. 5, the alternate example of the apparatus 10 is provided with a horizontal flare 20 which is further comprised a flare inset 70. An insert 72 is disposed on an end of the horizontal member 16. The flare inset 70 removably receives the insert 72 of the horizontal member 16. The circlamp 24 can thereby remain on the chair base 82 as chosen, while the remainder of the apparatus 10 an be disengaged from the circlamp 24 as chosen. Even though the apparatus 10 does not interfere with normal chair 80 use, the capability of removal of the post 12 provides even greater convenience to a user. Like the example of the circlamp 24 in FIG. 4, the circlamp 24 comprises a semicircular first clamp side 26. The first clamp side 26 is affixed to the horizontal flare 20. The semicircular second clamp 28 side is hingedly affixed to the first clamp side 26 via the hinge 30. A clamp side extension 32 is disposed on each of the first clamp side 26 and the second clamp side 28. Depending upon the example of the circlamp 24, one or more clamp studs 34 is passed through each clamp side extension 32. The illustrated example of the circlamp 24 provides 2 clamp studs 34. A wing nut 36 is provided for each clamp 34 such that the circlamp 24 is selectively tightened around the base 82 of a chair 80. A pair of spaced apart loops 40 is affixed to the second clamp side 28 of the circlamp 24.

Figure 3:
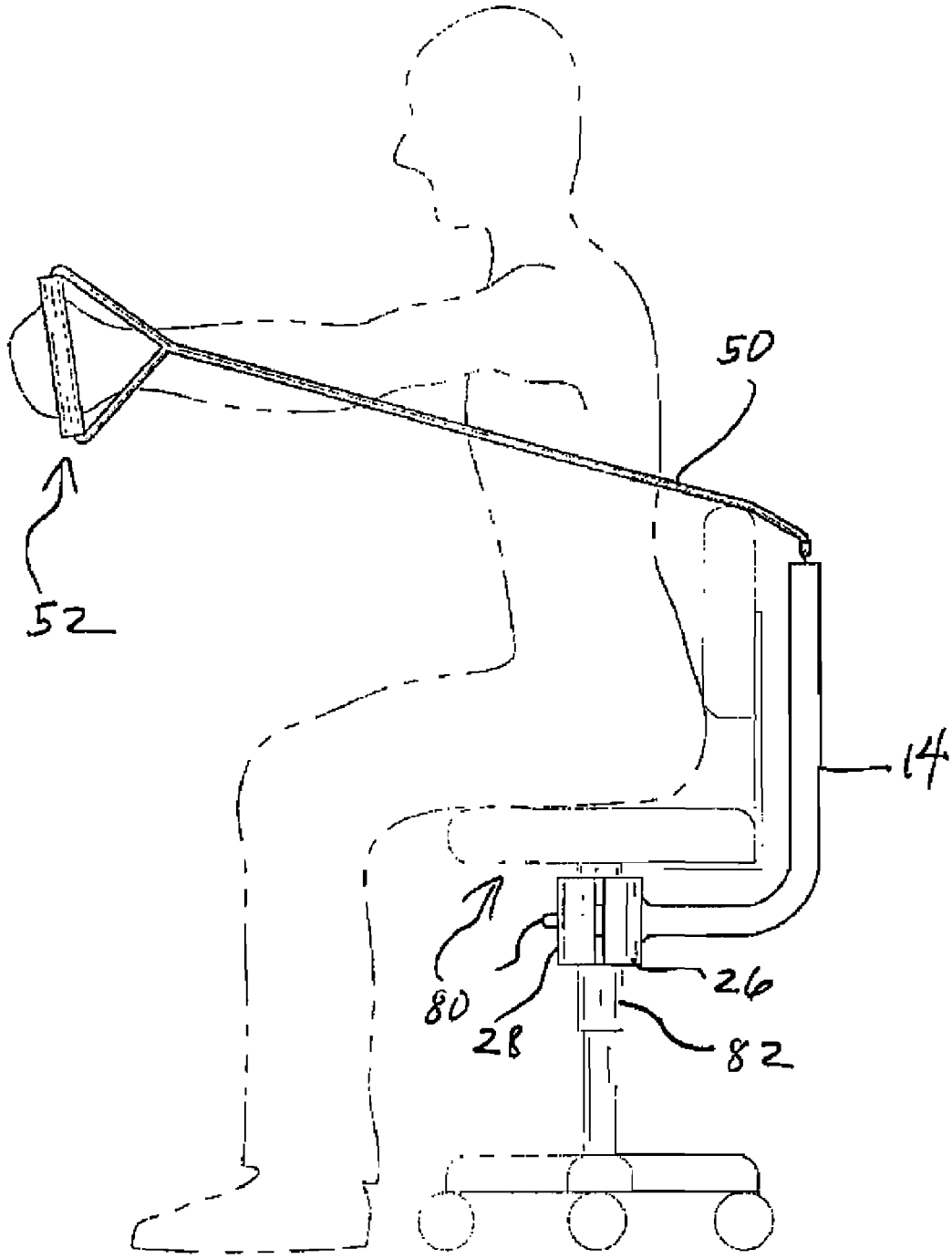
FIG. 3 is side elevation view of the apparatus affixed to a chair base.
Figure 6:
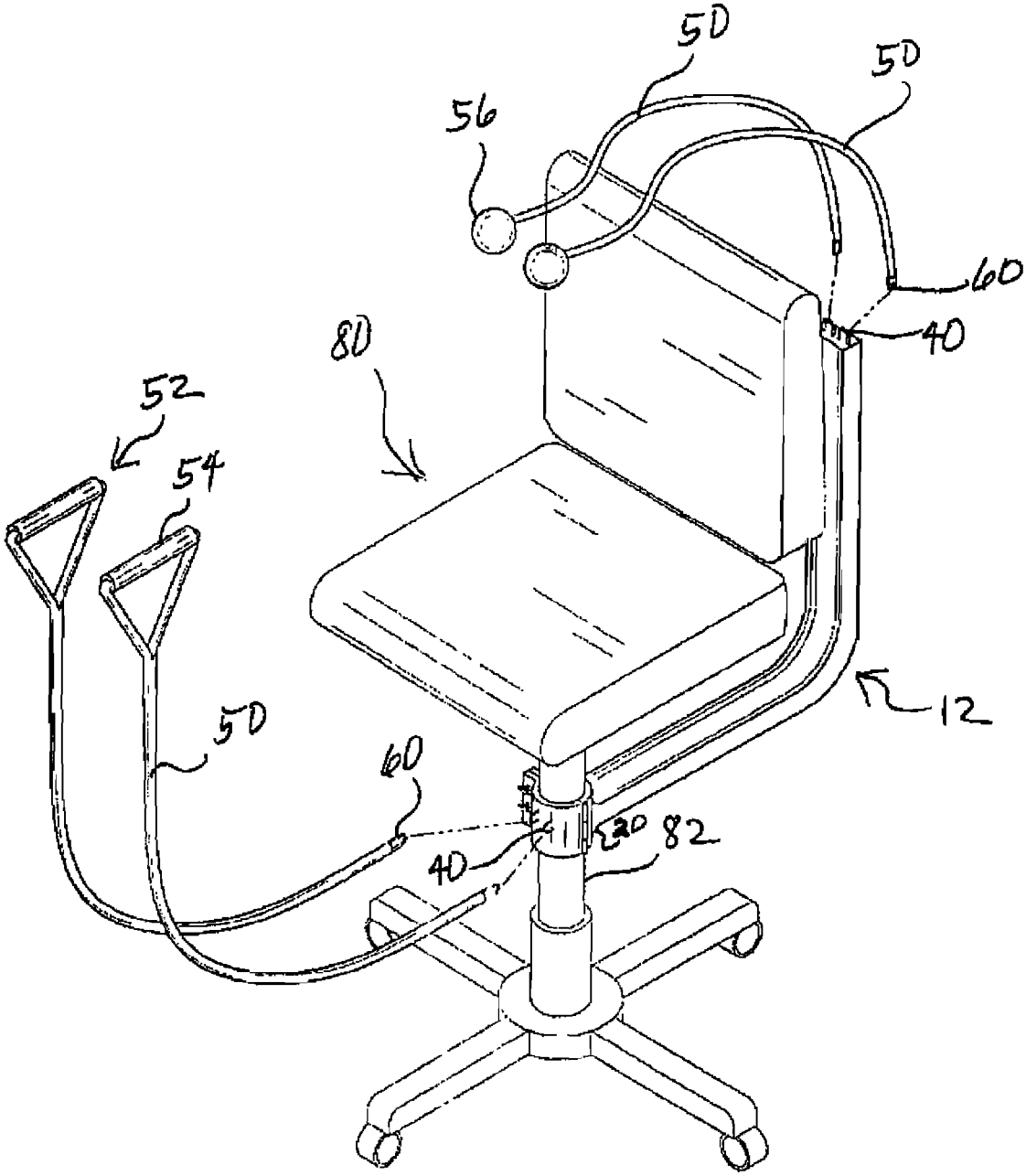
FIG. 6 is a perspective view of the apparatus affixed to an office chair base.

Referring to FIGS. 3 and 6, the two pairs of loop 40 attachments provided for a plethora of exercises, using the elastomers 50 as resistance. The elastomers 50 are provided in various lengths to further enable exercise variations, thereby further insuring the multi-exercise capability of the apparatus 10. Loop clips 60 are fastened to and unfastened from the loops 40 as chosen.

The loops 40 and elastomers 50 thereby provide for personal trunk extension and flexion exercises, and not just abdominal curls. The knobs 56 and triangular handles 52 provide varied grips for the elastomers 50. Arms, shoulders, legs, ankles, torso, and other chosen body parts can be exercised, from the chair 80, as a user chooses. The apparatus 10 provides resistance against forward movement, backward movement, lateral movement, angular movement, and a combination of the various movements.

With respect to the above description then, it is to be realized that the optimum dimensional relationships for the parts of the multi-exercise apparatus for chair base attachment, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the multi-exercise apparatus for chair base attachment.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the multi-exercise apparatus for chair base attachment may be used.

Therefore, the foregoing is considered as illustrative only of the principles of the multi-exercise apparatus for chair base attachment. Further, since numerous modifications and changes will readily occur to those skilled in the art, it is not desired to limit the multi-exercise apparatus for chair base attachment to the exact construction and operation shown and described, and accordingly, all suitable modifications and equivalents may be resorted to, falling within the scope of the multi-exercise apparatus for chair base attachment.

What is claimed is:

1. A multi-exercise apparatus for attachment to a chair base, the apparatus comprising:
a parallelepiped post, the post comprising:
a vertical member having a top, a bottom, and a length therebetween;
a pair of spaced apart loops affixed to a top of the vertical member;
a 90 degree bend in the bottom of the vertical member;
a horizontal member extended seamlessly from the 90 degree bend;
a clamp affixed to an end of the horizontal member;
means for affixing the clamp around the chair base;
two pair of elastomers, a first pair and a second pair, each pair having a first end, a second end, and a length therebetween;
a loop clip on the first end of each of the first pair and the second pair of elastomers;
a triangular handle on the second end of each of the first pair of elastomers;
a knob on the second end of each of the second pair of elastomers.

2. The apparatus in claim 1 wherein the horizontal member is further comprised of a horizontal flare encompassing an end of the horizontal member;
the clamp affixed to the flare.

3. The apparatus in claim 1 wherein a pair of spaced apart loops is affixed to the clamp.

4. The apparatus in claim 2 wherein a pair of spaced apart loops is affixed to the clamp.

5. The apparatus in claim 1 wherein the clamp further comprises a circlamp, the circlamp comprising:
a semicircular first clamp side;
a semicircular second clamp side hingedly affixed to the first clamp side;
a clamp side extension on each of the first clamp side and the second clamp side;
at least one clamp stud passed through each clamp side extension;
a wing nut for each clamp stud.

6. The apparatus in claim 2 wherein the clamp further comprises a circlamp, the circlamp comprising:
a semicircular first clamp side;
a semicircular second clamp side hingedly affixed to the first clamp side;
a clamp side extension on each of the first clamp side and the second clamp side;
at least one clamp stud passed through each clamp side extension;
a wing nut for each clamp stud.

7. The apparatus in claim 3 wherein the clamp further comprises a circlamp, the circlamp comprising:
a semicircular first clamp side;
a semicircular second clamp side hingedly affixed to the first clamp side;
a clamp side extension on each of the first clamp side and the second clamp side;
at least one clamp stud passed through each clamp side extension;
a wing nut for each clamp stud.

8. The apparatus in claim 4 wherein the clamp further comprises a circlamp, the circlamp comprising:
a semicircular first clamp side;
a semicircular second clamp side hingedly affixed to the first clamp side;
a clamp side extension on each of the first clamp side and the second clamp side;
at least one clamp stud passed through each clamp side extension;
a wing nut for each clamp stud.

9. A multi-exercise apparatus for attachment to a chair base, the apparatus comprising:
a parallelepiped post, the post comprising:
a vertical member having a top, a bottom, and a length therebetween;
a pair of spaced apart loops affixed to a top of the vertical member;
a 90 degree bend in the bottom of the vertical member;
a horizontal member extended seamlessly from the 90 degree bend;
an insert on an end of the horizontal member;
a clamp for removable attachment to the chair base;
a flare on a one side of the clamp;
a flare inset on the flare, the flare inset for removable receipt of the insert of the horizontal member;
two pair of elastomers, a first pair and a second pair, each pair having a first end, a second end, and a length therebetween;
a loop clip on the first end of each of the first pair and the second pair of elastomers;
a triangular handle on the second end of each of the first pair of elastomers;
a knob on the second end of each of the second pair of elastomers.

10. The apparatus in claim 9 wherein a pair of spaced apart loops is affixed to the clamp.

11. The apparatus in claim 9 wherein the clamp further comprises a circlamp, the circlamp comprising:
a semicircular first clamp side;
a semicircular second clamp side hingedly affixed to the first clamp side;
a clamp side extension on each of the first clamp side and the second clamp side;
at least one clamp stud passed through each clamp side extension;
a wing nut for each clamp stud.

12. The apparatus in claim 10 wherein the clamp further comprises a circlamp, the circlamp comprising:
a semicircular first clamp side;
a semicircular second clamp side hingedly affixed to the first clamp side;
a clamp side extension on each of the first clamp side and the second clamp side;
at least one clamp stud passed through each clamp side extension;
a wing nut for each clamp stud.

13. The apparatus in claim 9 wherein each triangular handle is further comprised of a handle cylinder.

14. The apparatus in claim 10 wherein each triangular handle is further comprised of a handle cylinder.

15. The apparatus in claim 11 wherein each triangular handle is further comprised of a handle cylinder.

16. The apparatus in claim 12 wherein each triangular handle is further comprised of a handle cylinder.

* * * * *